US010140967B2

(12) United States Patent
Fan

(10) Patent No.: US 10,140,967 B2
(45) Date of Patent: Nov. 27, 2018

(54) MUSICAL INSTRUMENT WITH INTELLIGENT INTERFACE

(71) Applicant: Magic Instruments, Inc., San Francisco, CA (US)

(72) Inventor: Brian Strom Fan, San Francisco, CA (US)

(73) Assignee: Magic Instruments, Inc., Marina Del Rey, CA (US)

( * ) Notice: Subject to any disclaimer, the term of this patent is extended or adjusted under 35 U.S.C. 154(b) by 201 days.

(21) Appl. No.: 15/069,710

(22) Filed: Mar. 14, 2016

(65) Prior Publication Data

US 2017/0263231 A1 Sep. 14, 2017

(51) Int. Cl.

| | |
|---|---|
| ***G10H 1/38*** | (2006.01) |
| ***G10H 1/34*** | (2006.01) |
| ***G10D 1/08*** | (2006.01) |
| ***G10H 1/00*** | (2006.01) |

(52) U.S. Cl.

CPC ..... *G10H 1/386* (2013.01); *G10D 1/085* (2013.01); *G10H 1/0066* (2013.01); *G10H 1/342* (2013.01); *G10H 2210/201* (2013.01); *G10H 2210/581* (2013.01); *G10H 2240/211* (2013.01)

(58) Field of Classification Search

CPC .. G10H 1/386; G10H 1/342; G10H 2210/581; G10H 2240/211

USPC ..... 84/613

See application file for complete search history.

(56) References Cited

U.S. PATENT DOCUMENTS

| | | | | | |
|---|---|---|---|---|---|
| RE31,019 | E * | 8/1982 | Evangelista | G10H 1/342 | 84/702 |
| 5,040,447 | A * | 8/1991 | Murata | G09B 15/003 | 84/477 R |
| 5,223,659 | A * | 6/1993 | Shiraki | G10H 1/342 | 84/669 |
| 6,111,179 | A * | 8/2000 | Miller | G10D 1/085 | 84/423 R |
| 8,796,529 | B2 * | 8/2014 | Butera | G10H 1/32 | 84/647 |
| 9,812,107 | B2 * | 11/2017 | Butera | G10H 1/342 | |
| 2010/0087254 | A1 * | 4/2010 | Sullivan | G10H 1/342 | 463/37 |
| 2013/0255474 | A1 * | 10/2013 | Hanks | G10H 1/342 | 84/615 |
| 2014/0290467 | A1 * | 10/2014 | Thee | G10H 1/0066 | 84/646 |
| 2015/0206521 | A1 * | 7/2015 | Sexton | G10H 3/146 | 84/609 |
| 2015/0262559 | A1 * | 9/2015 | Beck | G10H 1/0016 | 84/645 |
| 2015/0302758 | A1 * | 10/2015 | Tunogai | G10G 1/02 | 84/470 R |

(Continued)

*Primary Examiner* — Jeffrey Donels

(74) *Attorney, Agent, or Firm* — Bachmann Law Group PC

(57) ABSTRACT

A musical instrument with an improved interface for playing the instrument is provided. The musical instrument may be configured with a musical scale and a key. An input interface of the musical instrument may be configured based on the scale and key to allow a player of the instrument to easily play multiple collections of notes, or chords, in a simplified manner. For example, the improved interface allows a user to play a number of chords or other collection of notes without having to depress or engage a number of sound actuators at different locations along instrument.

46 Claims, 9 Drawing Sheets

(56) References Cited

U.S. PATENT DOCUMENTS

| | | | | |
|---|---|---|---|---|
| 2017/0278500 | A1* | 9/2017 | Hanks | G10H 1/342 |
| 2018/0047373 | A1* | 2/2018 | Butera | G10H 1/0066 |

* cited by examiner

| | Root Note | E | F# | G# | A | |
|---|---|---|---|---|---|---|
| | Fret | 1 | 2 | 3 | 4 | |
| String | 6 | 40,47,52,55,59,64 | 42,49,54,58,61,66 | 44,51,56,60,63,68 | 45,52,57,60,64,69 | parallel minor or major (opposite of String 1) |
| String | 5 | 40,47,52,56,59,62 | 42,49,54,58,61,64 | 44,51,56,60,63,66 | 45,52,57,61,64,67 | dominant 7th |
| String | 4 | 40,47,52,56,59,63 | 42,49,54,57,61,64 | 44,51,56,59,63,66 | 45,52,57,61,64,68 | major or minor 7th |
| String | 3 | 40,47,54,57,59,64 | 42,47,54,56,61,66 | 44,49,56,58,63,68 | 45,52,59,62,64,69 | suspended |
| String | 2 | 40,47,52,40,47,52 | 42,49,54,42,49,54 | 44,51,56,44,51,56 | 45,52,57,45,52,57 | power |
| String | 1 | 40,47,52,56,59,64 | 42,49,54,57,61,66 | 44,51,56,59,63,68 | 45,52,57,61,64,69 | major or minor, depending on the root chord of the scale |

FIGURE 7

MUSICAL INSTRUMENT WITH INTELLIGENT INTERFACE

BACKGROUND

Music has been an important part of human culture for thousands of years. Musical instruments have been created, developed, and modified over time to allow humans to make music. Though music has changed dramatically between cultures over the course of thousands of years, many instruments used to create music have not. A guitar, for example, has a number of strings that extend along a neck of the guitar, and when plucked or stricken will vibrate at a certain frequency. By modifying the tension on the strings through pressure from a player's fingers, the vibration frequency of the string and corresponding sound made by the vibrating string may be changed. The strings extend along a neck. This interface of a guitar has not been changed in hundreds of years.

Though a musician playing an instrument may make playing that instrument look simple, it is difficult for inexperienced users to play many musical instruments. Typically, it takes thousands of hours of practice to develop the necessary motor skills, combined with music lessons to obtain the musical knowledge, for a person to achieve a high level of proficiency on a musical instrument. In the modern era, many games and devices seek to allow an individual to play a musical instrument, such as a guitar, without having to depress strings on a guitar neck or strum the guitar strings. These instruments succeed in outputting sound, but generally have limited musical range and expressiveness, still require musical knowledge, and do not provide the user with a rewarding experience while playing the instrument. What is needed is an improved musical instrument.

SUMMARY

The present technology, roughly described, includes a musical instrument with an improved interface for playing the instrument. The musical instrument may be configured with a musical scale and a key. An input interface of the musical instrument may be configured based on the scale and key to allow a player of the instrument to easily play multiple collections of notes, or chords, in a simplified manner. For example, the improved interface allows a user to play a number of chords or other collection of notes without having to depress or engage a number of sound actuators at different locations along instrument.

An embodiment may include a system for playing music with a configurable playing interface. The system may include a housing, a plurality of chord selectors, an actuator, and logic. The plurality of chord selectors can be displaced on the housing. The actuator may be displaced on the housing. The logic can be connected to the plurality of chord selectors and the actuator and can map note and/or sound data to the plurality of chord selectors. The note and/or sound data mapped to the plurality of chord selectors can be based on a key and scale selection associated with the device. The logic can output note and/or sound data in response to a first input received to a selected chord selector of the plurality of chord selectors and a second input to the actuator. The note and/or sound data can be output to audio processing circuitry that creates audio based on the note data.

An embodiment may include a method for playing a musical device with a configurable playing interface. A selection of a scale and a key may be received by the musical device. A plurality of chord selectors may be configured on the musical device based on the scale and key. A first input may be received at a selected chord selector of the plurality of chord selectors to select a specific chord. A second input may be received at an actuator on the musical. Note data may be created in response to receiving the first input and the second input, wherein the note data is based on the scale and key.

BRIEF DESCRIPTION OF THE DRAWINGS

FIG. 7 illustrates MIDI note values for chord selectors in representative chord selector positions on a musical instrument.

DETAILED DESCRIPTION

Figure 1:
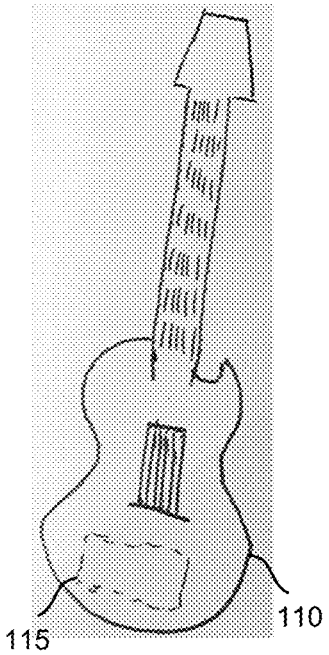
FIG. 1 is an illustration of a musical instrument of the present technology.

The present technology provides a musical instrument with an improved interface for playing the instrument. The musical instrument may be configured with a musical scale and a key. An input interface of the musical instrument may be configured based on the scale and key to allow a player of the instrument to easily play multiple collections of notes, or chords, in a simplified manner. For example, the improved interface allows a user to play a number of chords or other collection of notes without having to depress or engage a number of sound actuators at different locations along instrument.

One example of a musical instrument with an improved interface may be a guitar. In the case of a guitar, the improved interface may allow a user to play a number of guitar chords or other collection of notes without having to depress strings at various positions along the neck of the guitar. The guitar neck may include a plurality of chord selectors, implemented in some instances as buttons. The chord selectors may be depressed or otherwise selected by a user. When a chord selector is actuated, digital data for generating audio is configured for each string of the guitar. When a user strums one or more strings of the guitar while depressing a particular chord selector, audio is generated, such as notes corresponding to a chord associated with the chord selector, and output by the guitar.

Though references may be made to a guitar in the specification and drawings, these references are intended to be exemplary. The present technology may be used with and applied towards any musical instrument, and the implementations and examples with respect to a guitar are not intended to be limiting but rather for exemplary purposes.

A musical instrument may include a body and a neck, strings that extend at least partially over the body, and a number of chord selectors positioned along the neck of the instrument. The instrument may be configured with a scale and a key, which may be received from a user at either the musical instrument or a computing device in communication with the instrument.

When a scale and key are selected, a chord having a root note of each note in the scale and key is assigned to a chord selector along a row of chord selectors that extends along the length of the neck. Each row of chord selectors may extend along the length of the neck, and may line up with a string of the guitar, wherein each string may not extend the entire length of the neck. A first row of chord selectors may extend as a bottom row along the neck and be aligned with string one (1) on the guitar.

For example, if the Major (diatonic) scale is selected, there are seven root notes—each root note is associated with a degree in the Major scale: tonic, supertonic, median, subdominant, dominant, submediant, and leading tone. Each column of chord selectors (each column may be considered a "fret") extending up the length of the instrument neck is assigned to a root note for each degree in the scale. For example, if the selected key is E and the selected scale is Major, a chord at a first fret (on the guitar neck at the position furthest away from the player of the instrument) will have the root note E. Moving up the length of the neck towards the user, the root notes of the next six frets are F#, G#, A, B, C#, and D#, respectively. The base chords in each fret, assigned to the chord selectors on string 1, are the diatonic chords of the E Major scale, which are the E Major chord (assigned to the chord selector on fret 1 and the first or bottom most row of chord selectors that extend along the length of the neck, aligned with string 1), the F# minor chord (assigned to the chord selector on fret 2 and first chord selector row aligned with string 1), the G# minor chord (assigned to the chord selector on fret 3 and first chord selector row aligned with string 1), the A Major chord (assigned to the chord selector on fret 4 and first chord selector row aligned with string 1), the B Major chord (assigned to the chord selector on fret 5 and first chord selector row aligned with string 1), the C# minor chord (assigned to the chord selector on fret 6 and first chord selector row aligned with string 1), the D# diminished chord (assigned to the chord selector on fret 7 and first chord selector row aligned with string 1).

Additional chord selectors that extend along the width of the neck (in a column or fret of chord selectors) may be associated with a corresponding variation of chords, all having the same root note. For example, chord variations for the root note E can be an E power chord (assigned to the chord selector on fret 1 and second chord selector row aligned with string 2), E suspended chord (assigned to the chord selector on fret 1 and third chord selector row aligned with string 3), E major $7^{th}$ chord (assigned to the chord selector on fret 1 and fourth chord selector row aligned with string 4), E dominant 7th chord (assigned to the chord selector on fret 1 and fifth chord selector row aligned with string 5), and E parallel minor chord (assigned to the chord selector on fret 1 and sixth or bottom chord selector row aligned with string 6). The variation chords extending along the width of the neck in the second fret may include an F# power chord (assigned to the chord selector on fret 2 and second chord selector row aligned with string 2), F# suspended chord (assigned to the chord selector on fret 2 and third chord selector row aligned with string 3), F# minor $7^{th}$ chord (assigned to the chord selector on fret 2 and fourth chord selector row aligned with string 4), F# dominant $7^{th}$ chord (assigned to the chord selector on fret 2 and fifth chord selector row aligned with string 5), and F# parallel major chord (assigned to the chord selector on fret 2 and sixth chord selector row aligned with string 6).

Additional chord selectors in specific frets may also be used to provide chords outside of the selected scale. In the previous example, a Major (diatonic) scale has 7 notes per octave, whereas in a chromatic scale, there are 12 notes per octave. The 5 additional notes (in the chromatic scale but not in the Major diatonic scale) can form the root notes of chords not within the Major scale. Hence, after the first seven columns (or frets) of chord selectors, the eighth fret may be used to include the additional five "out of scale" major chords (each based on a different root note found in the chromatic scale but not in the diatonic scale) and the ninth fret may be used to include the additional five "out of scale" minor chords (each based on a different root note found in the chromatic scale but not in the diatonic scale). Additional types of chords (such as seventh chords, power chords, etc.) that are commonly used but not in the current diatonic scale may also be associated with additional chord selectors in subsequent frets.

Once the scale and key are known, and a chord is associated with each chord selector along the neck of the instrument, the user may strum or otherwise engage the strings (or actuators) of the instrument to play the particular chord. Each string is assigned a singular note value (for example, MIDI note values) for each chord assigned to a chord selector. When a chord selector is depressed by a user, and a string is plucked by a player, the note value associated with the plucked string is used to generate audio of the selected note. When multiple strings are struck by a player, each string plays the single note that has been assigned to it, but striking strings in quick succession (as in a single swift downward or upward strum motion) has the impact of sounding multiple notes played virtually simultaneously, so a listener hears an entire chord played. Logic embedded in the guitar generates instructions to create sounds (either by playing pre-recorded samples of notes, by sound synthesis, or by exporting MIDI note values to an external audio program which generates the audio) based on the note and velocity values associated with the plucked strings and depressed chord selector. The generated sounds may be further processed with modulation or digital signal processing effects to create variations of sounds as desired.

Figure 4:
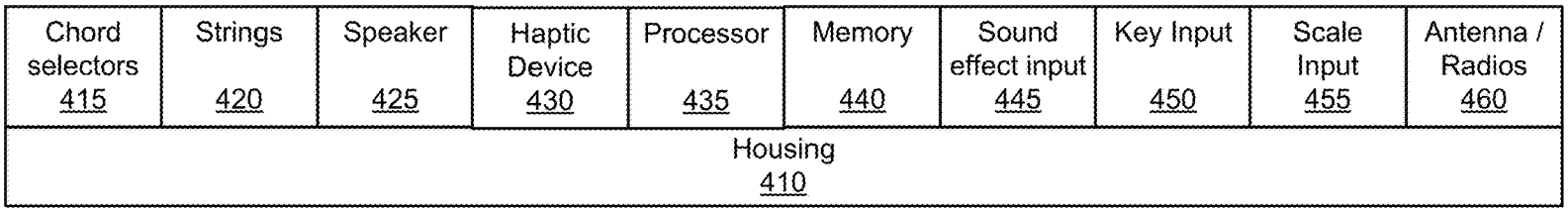
FIG. 4 is a block diagram of hardware components for a musical instrument.
Figure 5:
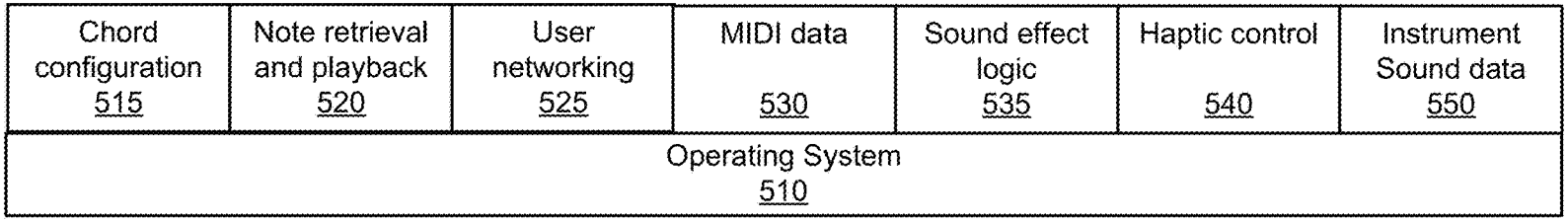
FIG. 5 illustrates a block diagram of logical software modules for a musical instrument.

FIG. 1 is an illustration of a musical instrument of the present technology. The instrument 110 may include logic, circuitry and controls 115. The logic, circuitry and controls may allow user to configure a key and a scale, provide input to configure sound effects, for example through one or more control knobs, and other elements that will be applied to sounds output at the instrument 110. In some instances, the circuitry may include one or more of elements 415-460, all encased or positioned around housing 410, as illustrated in FIG. 4. The logic may include one or more modules, such as objects, portions of programming code, or other code, that implement one or more of modules 515-550 on an operating system 510 as illustrated in FIG. 5. In the musical instrument of FIG. 1, the instrument is completely independent of any outside device, may be configured with key and scale based on input mechanisms included on instrument 110, and played independently from any other system or device.

Figure 2:
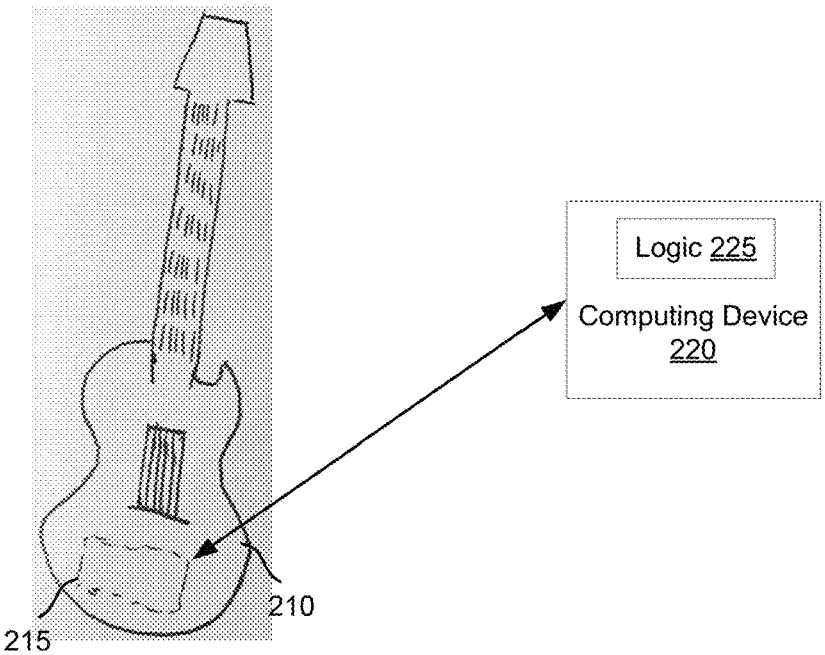
FIG. 2 is an illustration of a musical instrument that communicates with a remote computing device.

FIG. 2 is an illustration of a musical instrument that communicates with a remote computing device 220. Instrument 210 may include logic, circuitry, and controls 215. Computing device 220 may also include logic, circuitry, and controls 225. The logic and circuitry may allow user to configure a key and a scale at either the instrument 210 or computing device 220. The controls allow a user to provide input to configure sound effects that will be applied to sounds output at the instrument 210. In some instances, the circuitry may include one or more elements 415-460 at either instrument 210 or computing device 220. In some instances, processor 435, memory 440, sound effect input 445, key input 450, and scale input 455 may each be provided either at instrument 210 or computing device 220. Each of instrument 210 and computing device 220 may include antennas and radios for wirelessly communicating with each other. (Alternately, instrument 210 and computing device 220 may communicate through a direct (wired) connection such as USB, Lightning, Ethernet, or other type of data cable.) Logic 215 and logic 225 may each include one or more modules, such as objects, portions of programming code, or other code, that implement one or more of modules 515-550 on an operating system 510 as illustrated in FIG. 5.

Computing device 220 may include a mobile device, desktop computer, laptop computer, or other computing device for receiving input from a user and configuring instrument to 10 based on the received input. A description of elements that may be found in computing device 220 is discussed in more detail with respect to the system of FIG. 10.

In some instances, each of musical instruments 110 and 210 may establish connections and communicate with additional musical instruments of the present technology. When connected, the instruments may be configured to play together simultaneously. For example, the chord selector configuration may be configured such that a first instrument is configured to play chords in a first octave while the second instrument is configured to play in a second octave. Alternately, the chord selector configuration may be configured such that a first instrument is configured to play chords in a particular chord voicing, while a second instrument is configured to play chords in an alternate chord voicing. Another configuration is for a first instrument to play chords in one inversion, such as root position, while a second instrument is configured to play chords in first inversion, while a third instrument is configured to play chords in second inversion. The instruments may additionally be configured to output different guitar or instrument sounds. Establishing a connection between two or more instruments of the present technology and configuring the instruments based on the connection is discussed with respect to the method of FIG. 8

Figure 3:
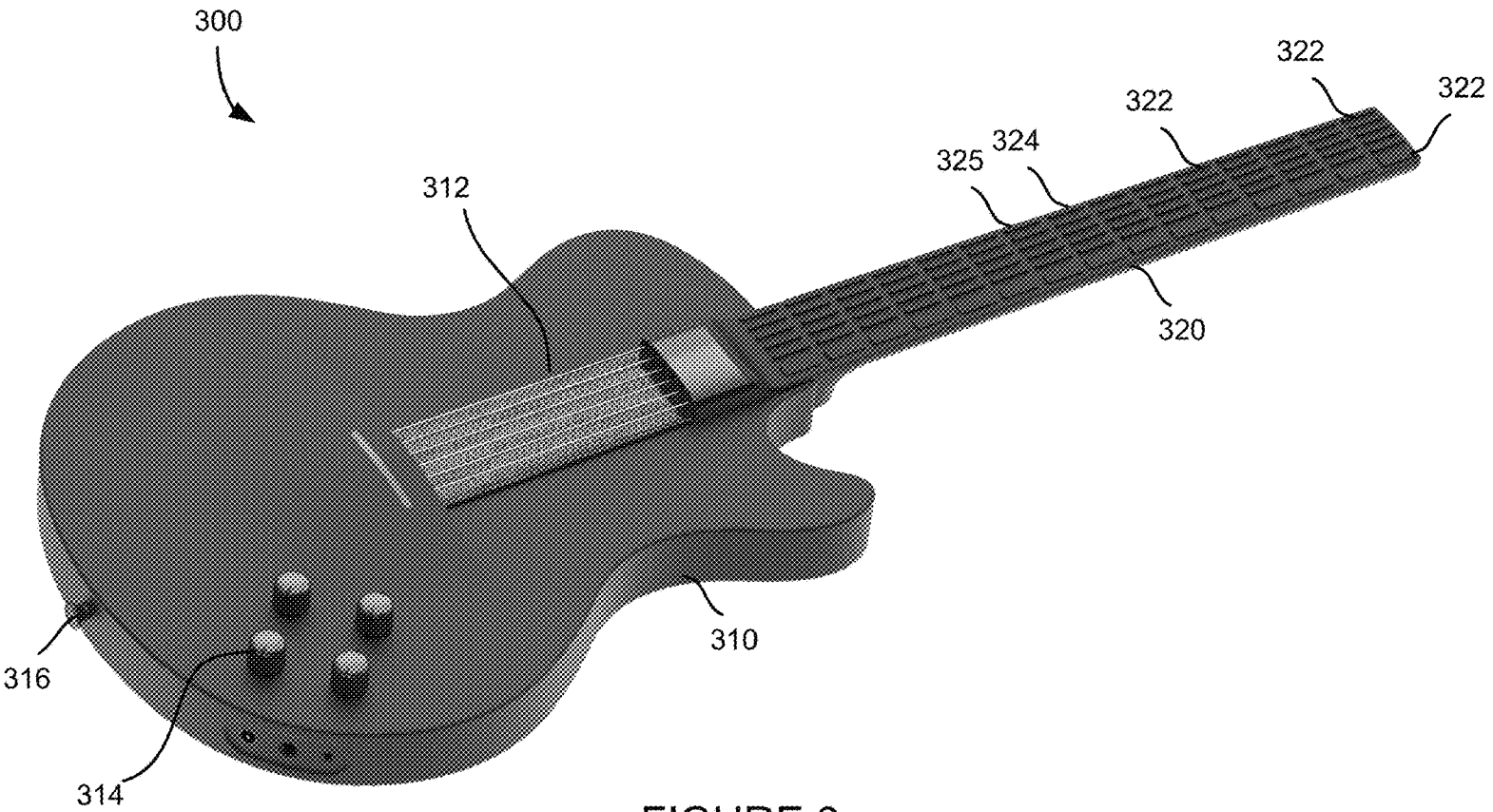
FIG. 3 illustrates an exemplary guitar of the present technology.

FIG. 3 illustrates an exemplary instrument. The instrument 300 of FIG. 3 includes a body 310 and a neck 320. The body includes strings 312, control knobs 314, and strap connector 316. Strings 312 may extend along a portion of the body. Each string may be connected to circuitry or other components that may detect the vibration of the string. The circuitry may determine the force at which a string was plucked or engaged as well as how hard or the velocity at which the string was engaged. The circuitry that detects string vibration information may provide that information to logic contained within the instrument or to logic contained at a remote computing device 220.

Control knobs 314 may control aspects of the sound such as volume, tone, and other modulation and signal processing effects, such as for example chorus, reverb, echo, phaser, flanger, compression, and other effects. The control knobs may be coupled to circuitry and/or software that adjusts or processes the audio output of the guitar based on the setting of the knobs. In some instances, the instrument may also utilize an accelerometer or gyroscope (on the internal circuit board) for tremolo effect, and a whammy bar (not shown) for vibrato effect.

In some instances, one or more control knobs, or other input mechanisms (not illustrated) on instrument 300, may be used to select a scale and key. For example, the knobs, a slider, a dial, a touch screen, or other input device may be used to indicate a particular scale and key from which the chord selectors may be mapped to note values.

Neck 320 may include chord selectors 322, 324, and 325. In some instances, six rows of chord selectors may extend along the length of the neck 320, each row corresponding to a string. In some instances, fewer or more than six rows of chord selectors, e.g. could be a range from 1 to 20 chord selectors per fret, may be implemented on an instrument of the present technology. The row along the bottom of the neck may correspond to diatonic chords having a root note that matches the particular degree of a scale selected for the instrument. The other rows of chord selectors may include variations of chords in each particular root note. Columns of chord selectors may appear in the position of a fret on a traditional guitar, and each column of chord selectors may be based on a particular note within a scale.

Chord selectors 324 and 325 may be used to provide chords that do not fit within the first seven notes of a particular scale. For example, chords placed at chord selectors 324 may be based on root notes corresponding to degrees of the chromatic scale (which has twelve notes per octave), but are not part of the diatonic scale (which has seven notes per octave). Chord selectors 324 positioned at the eighth fret may include major chords based on root notes corresponding to degrees of the chromatic scale but not in the diatonic scale, and chord selectors 325 positioned at the ninth fret may include minor chords based on root notes corresponding to degrees of the chromatic scale but not in the diatonic scale. The extra frets discussed herein cover Major and Minor chords for the root notes corresponding to degrees of the chromatic scale but not in the diatonic scale, but an instrument of the present technology may include additional frets to cover additional chord variations, such as power chords, suspended chords, Major seventh chords, minor seventh chords, dominant seventh chords—all built on root notes corresponding to degrees of the chromatic scale but not in the diatonic scale.) The $10^{th}$ fret and other frets along the neck closer to the strings may include additional chords based on the scale but at a different octave(s) than the first seven frets.

FIG. 4 is a block diagram of hardware components for a musical instrument. The hardware components of FIG. 4 include chord selectors 415, strings 420, a speaker 425, haptic device 430, processor 435, memory 440, sound effect input 445, key input 450, scale input 455, and antenna and radios 460. When implemented in a musical instrument, elements 415-460 may be included within or positioned upon housing 410. In the case when a musical instrument communicates with a remote computing device, the chord selectors, strings, speaker and haptic device may be implemented within the musical instrument and a processor, memory, sound effect input, key input, scale input, and antennas and radios may implemented in either or both of a musical instrument and a remote computing device in communication with the instrument.

FIG. 4 illustrates exemplary components, and an instrument of the present technology may include additional components. For example, an instrument of the present technology may also include one or more of an audio line out (i.e., allowing the instrument to be plugged into external effects pedals, amplifiers/speakers, audio mixers, and recording devices), a headphone output, MIDI ports (for MIDI data input/output), whammy/tremolo bar (for vibrato effect), and accelerometer and/or gyroscope (for tremolo effect and other motion-triggered effects).

The chord selectors 415 and strings 420 may be similar to those discussed with respect to the musical instrument of FIG. 3. Speaker 425 may be implemented within the body of musical instrument 310 and may output audio based on the scale, key, and sound effect configuration of the musical instrument, as well as the user selection of a chord selector and strumming of the strings of the musical instrument.

Haptic device 430 may be positioned within the body of musical instrument 310, or on the back side of the instrument. In some instances, the haptic device may vibrate at a rhythm or tempo associated with a song or musical composition. A user may use the periodic vibration of the haptic device to determine the beat or tempo of the song. In some instances, the haptic device may provide signals as to when chord should be played, the start of a song, the end of a song, the start of an instrumental solo, the end of an instrumental solo, and other information regarding play of the musical instrument. Signals may be provided to the haptic device by logic contained within the guitar or the computing device 220 that are generated in association with a song being played by one or more users, including a user that is playing the instrument with the haptic feedback element.

Processor 435 may be implemented within the instrument and execute instructions stored in memory to retrieve note values, such as for example MIDI note values, to be mapped to each chord selector based on received key and scale input, process sounds based on sound effect inputs (control knobs), communicate with computing device 220 over antennas and radios 460, and perform other functionality discussed herein. Sound modulation and digital signal processing effect inputs 445 may include the control knobs discussed with respect to the instrument of FIG. 3. The key input 450 and scale input 455 may be provided on the surface of the musical instrument, for example near the control knobs, implemented using chord selectors 322, implemented within a computing device, or both. On the musical instrument, the key input 450 and scale input 455 may be implemented as a touch-screen display, dials, sliders, switches, motion-sensitive sensors, or some other input mechanism. When implemented on a computing device 220, the input may be received through an interface provided by the computing device.

Antenna and radio circuitry 460 may be included in musical instrument 210 and computing device 220 to allow communication between each other. Antenna and radios may also be provided in a musical instrument 110 that does not communicate with computing device 220, for example to enable the user to listen to the output of the music instrument through a headset or external speaker, such as for example a Bluetooth headset or Bluetooth speaker, or to listen to the output of an external music player through the guitar's speaker, or to enable a musical instrument to establish a connection directly with another musical instrument of the present technology. Alternately, musical instrument 210 and computing device 220 may communicate via a direct (wired) connection.

FIG. 5 illustrates logical software modules which may be implemented in a musical instrument and computing device. The logical software modules may include a chord configuration module 515, note retrieval and playback module 520, user networking module 525, MIDI data 530, sound effect logic 535, haptic control 540, and instrument sound data, all of which may be implemented on an operating system 510. Each of the modules may be implemented on either musical instrument or a remote computing device 220.

Chord configuration module 515 may map note values (such as MIDI values) to chord selectors based on the scale input and key input received from a user. The chord configuration information may specify what note values should be output based on a particular chord selector input. The note values may include one or more values when a particular note is played, and a plurality of values when a chord is played (by strumming one or more strings). Note values may be retrieved from a data store or memory located on the musical instrument or remotely from computing device 220.

User networking module 525 may connect instruments and configure instruments for playback during a musical session, such as playback of a song. User networking 525 may include logic to assign or modify chord mapping based on parameters such as the number of connected instruments, the role of each instrument, and other information.

In some instances, the musical instrument may use the Musical Instrument Digital Interface (MIDI) protocol for describing notes and instrument sounds to be played by the musical instrument. The MIDI data 530 may include note data associated with each chord mapped to a particular chord selector, MIDI instructions and parameter data, and other data, instructions and protocols used to produce sounds by the musical instruments. The MIDI note data, velocity data, sysex messages, and other MIDI related data may be stored locally on the musical instrument and loaded as needed or remotely to computing device 220.

The sound effect logic 535 may include logic for adjusting the volume, attenuating the volume, adjusting the tone, and providing modulation and/or signal processing effects. The effects may include for example processing the output to represent a chorus, provide reverb, echo/delay, phaser, flanger, compression, and other effects. Haptic control 540 may include logic for vibrating a haptic element on the musical instrument body. Haptic control logic may include a frequency and intensity of which to vibrate the haptic element, when to vibrate haptic elements, and other logic.

The instrument sound data 550 may be mapped to MIDI data 530 and may be used to create audio that is output when particular MIDI data is specified and generated by user input of a chord selector and one or more strings. The instrument sound data may include a database of recorded guitar samples (audio recordings of individual notes covering all MIDI note values played on a traditional guitar) and other instrument sounds. Alternatively, the instrument can include an onboard synthesizer (not shown in FIG. 4) that generates the audio for each MIDI note value. Alternatively, MIDI data can be exported to a computing device which generates audio (for example, MIDI data can be exported from the guitar via a MIDI cable to a laptop computer running Digital Audio Workstation (DAW) software (such as for example Logic Pro Software, by Apple, Inc.) that generates the audio.

Figure 6:
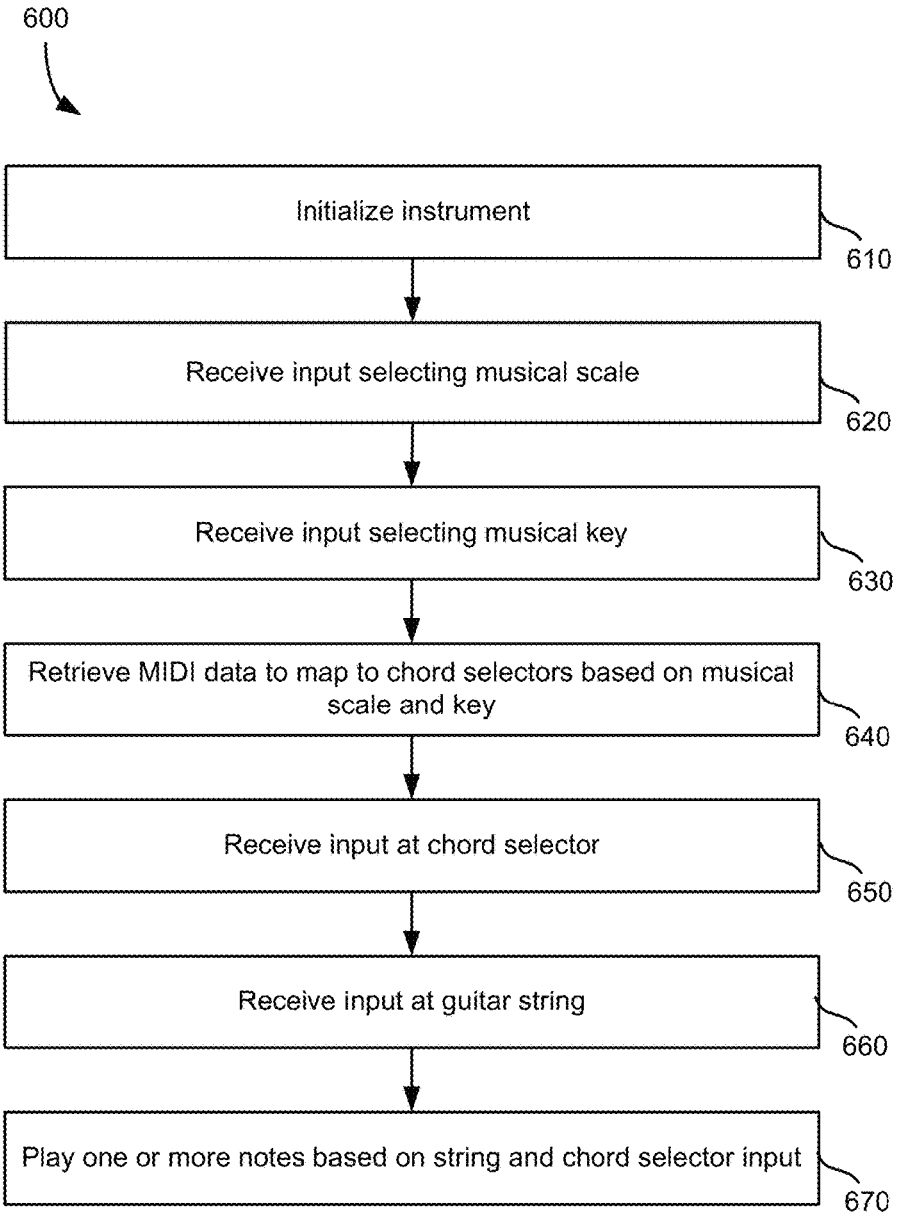
FIG. 6 is a method for playing a musical instrument.

FIG. 6 is a method for playing a musical instrument. Though method of FIG. 6 may refer to strings or other actuators, this is for purposes of discussion only. It is intended that the present technology may be utilized with different actuators, including switches, buttons, and so forth, and the number of actuators can vary widely (e.g. 1 actuator up to 20 or more actuators).

The instrument is initialized at step 610. Initialization may include powering up the instrument. In some instances, initialization may include connecting or pairing the instrument to a remote computing device that may provide input to the instrument or otherwise configure the instrument.

Input selecting the musical scale is received at step 620. The selected musical scale may be one of any of a plurality of scales, For example, the scale may be one of the Major, Melodic Minor, Harmonic Minor, Major Pentatonic, Minor Pentatonic, Blues, Mixolydian mode, Aeolian mode, Dorian mode, Phrygian mode, Lydian mode, Gypsy, Chromatic, Microtonal, Hejaz, Diminished, Whole Tone, Persian, Scottish, Hirojoshi, and Arabian. A scale may also be a modified version of the above listed scales, such as Major with a flat VII.

The scale may be received at the instrument, such as for example by a touch input display, an input dial, a slider, a button, knob, chord selector, string actuator, or some other input or combination of inputs. Alternately, when the musical instrument is initialized, it may be set automatically in a default scale. The input may also be received at a computing device in communication with musical instrument. In this implementation, the musical scale input may be received through a graphical user interface provided by software executed by the computing device. Alternately, a scale may be associated with specific songs in a database. When a particular song is selected, its scale may be transmitted automatically to the musical instrument.

Input selecting a musical key is received at step 630. Musical key may be received at an instrument or at a computing device in communication with the instrument. The received key may be any of C, C-sharp/D-flat, D, D-sharp/E-flat, E, F, F-sharp/G-flat, G, G-sharp/A-flat, A, A-sharp/B-flat, and B, or in the case of non-western music, a key based on a semitone, quartertone, or microtone. The key input may be received at the instrument, such as for example by a touch input display, an input dial, a slider, a button, knob, chord selector, or some other input or combination of inputs. Alternately, when the musical instrument is initialized, it may be set automatically in a default key. The key input may also be received at a computing device in communication with musical instrument. In this implementation, the key input may be received through a graphical user interface provided by software executed by the computing device. Alternately, a key may be associated with specific songs in a database. When a particular song is selected, the song's key may be transmitted to the musical instrument, and the instrument can be automatically set to the song's key.

Note data may be retrieved based on the scale and key at step 640. The note data may be retrieved from a lookup table in the musical instrument firmware, or from a remote computing device 220. Note data is mapped to chord selectors based on the musical scale and key. For example, for a particular major chord for a guitar instrument, the note data may include six values, one value for each string in the chord.

A table of representative MIDI note values to a plurality of chord selectors is displayed in the table of FIG. 7. The table FIG. 7 illustrates MIDI note values for chord selectors in positions on the musical instrument relative to the strings. For example, MIDI values are provided for 24 chord selectors. Each chord selector is assigned a set of six MIDI values, one for each string. For example, there are four columns (or frets) of chord selectors for each of strings 1 through 6. An actual musical instrument such as a guitar may include more than four frets—the subset of MIDI note data for four frets shown in the table of FIG. 7 is provided for purposes of discussion only.

The note values correspond to a key of 'E' and a selected scale of 'Major.' For the E root note at fret one, corresponding to the fret positioned furthest away from the body the musical instrument, the MIDI note values for the minor variation chord (in line with string 6) are 40, 47, 52, 55, 59 and 64. For the F# root note at fret two, the MIDI note values for the minor $7^{th}$ chord variation which is lined up with string four are 42, 49, 54, 57, 61, and 64. As shown, MIDI note values are mapped to each chord selector such that each of the mapped MIDI note values is associated with a particular string. When the chord selector is depressed or otherwise engaged, and one or more of the strings is strummed, instructions will be generated to generate sound based on the MIDI note value associated with each strummed string.

Returning to the method of FIG. 6, input is received at a chord selector at step 650. Input may be received as a user depresses a particular chord selector with one of the user's fingers. In some instances, input may be received as a user depresses two or more chord selectors simultaneously. Input may be received at a string of the musical instrument at step 660. Input at a guitar string may be applied by user's finger, a pick, or in some other manner that causes string to be momentarily displaced from an at rest position and then released, thereby causing the string to vibrate.

One or more notes may be played based on the string input and chord selector input received at the musical instrument at step 670. The notes may be based on MIDI note data mapped to the chord selector, the particular strings strummed, the velocity at which each string is strummed, and a specific chord voicing or inversion setting that has been selected. The sound provided by the musical instrument may also be dependent on sound effects setting. Playing one or more notes based on string and chord selector input is discussed with respect to the method of FIG. 8.

Figure 8:
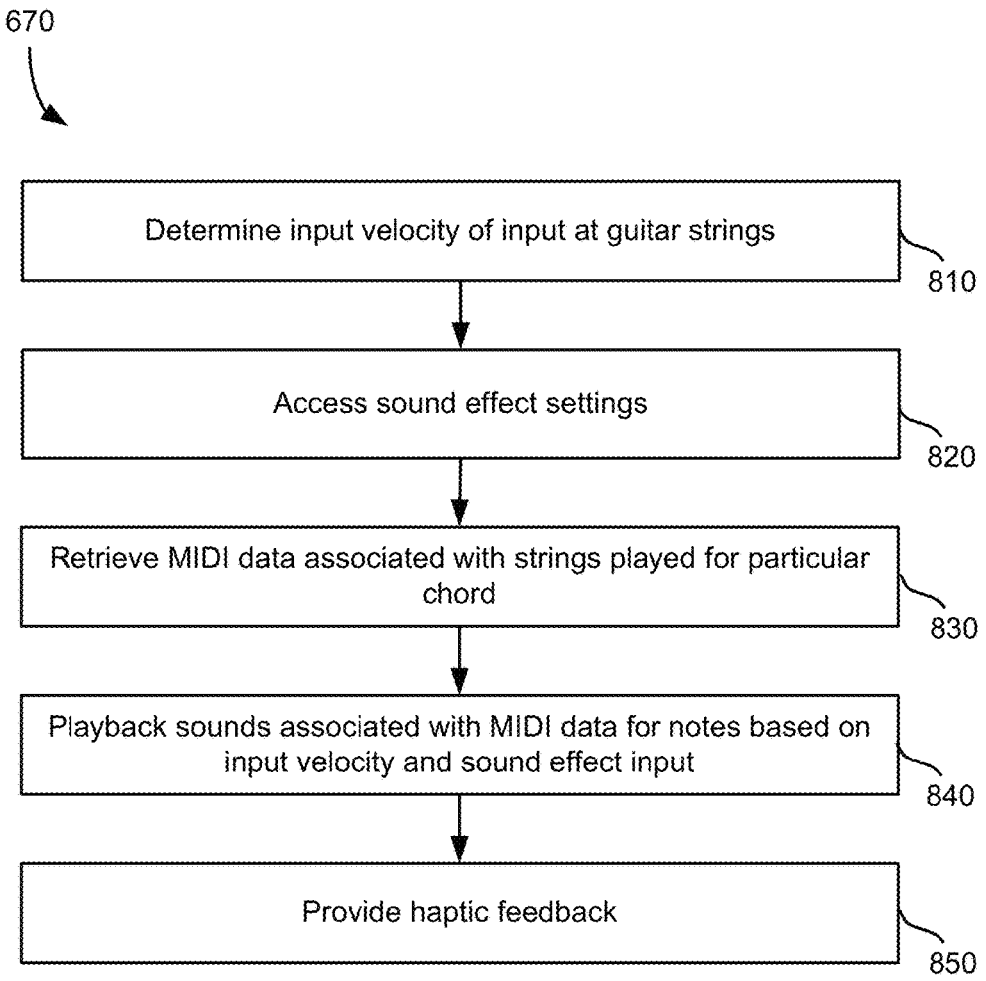
FIG. 8 is a method for playing one or more notes based on a string input and chord selector input.

FIG. 8 is a method for playing one or more notes based on a string input and chord selector input. Method of FIG. 8 provides more detail for step 670 of the method of FIG. 6. First, an input velocity is determined for the strumming of the guitar strings at step 810. A velocity of the strumming input may affect the magnitude of a vibration of a particular string. Sensors at each string may be used to determine the vibrational magnitude. The volume for a particular note corresponding to a string may be correlated to a velocity range or vibration magnitude range. For instance, a string with a vibration magnitude that falls in a higher magnitude range may be configured with a higher volume of playback than a second string that falls into a lower magnitude range.

Sound effects settings may be accessed at step 820. The sound effects settings may include overall volume, tone, chorus, reverb, echo/delay, phaser, flanger, compression, and other modulation effects that may be applied to output of the notes associated with strings strummed by a user. The MIDI note and velocity data or other data values associated with the strings played for the particular chord are retrieved at step 830. The MIDI note data is associated with a particular chord selector that was engaged by user at the time the strings are strummed. In some instances, the data values associated with strings played for a particular chord are pre-loaded upon selection of a key and scale, and thus only need to be accessed from cache or memory.

Sounds are output by the musical instrument based on the retrieved MIDI note data, input velocity values and sound effect settings input at step 840. Output of the sound may include generating one or more instructions to create a note based on MIDI values mapped to a particular string that were struck by the user. The instructions may also process the sound based on the accessed sound effects settings. In some instances, additional circuitry and/or software algorithms may be used to process the sound based on the accessed sound effects settings after an audio signal has been generated based on the instructions.

When multiple instruments of the present technology are played together, the playback may be coordinated in terms of scale, key, chord variation, chord voicings, instrument sounds, sound effect settings, and other aspects of music playback on the instruments. The multiple instrument coordination may be performed automatically or manually by the players themselves. When multiple instruments are correlated by users manually, each user may select a role of for their instrument, a chord voicing configuration, an octave range, an instrument sound, a sound effects setting, and other configurations for their instrument. When music instruments are correlated together automatically, each musical instrument of the present technology utilizes onboard intelligence to enhance an experience of multiple players as they play musical instruments of the present technology together. The intelligence may automatically configure one or more of the multiple players' musical instruments to play in a different octave or note range, in a different key or scale, configure their instruments with a different chord voicing or inversion setting, with a different instrument sound, with a different sound effects setting, or in some other way, modify how two or more instruments are playing together. When done automatically, the process may proceed as described with respect to the method of FIG. 9.

Haptic feedback is provided at step 850. Haptic feedback may be provided based on the rhythm of a song or usable composition, provide haptic notifications regarding when playback of an instrument starts, when playback of instrument should end, and other indicators of certain portions of a song or musical composition played by the user.

Figure 9:
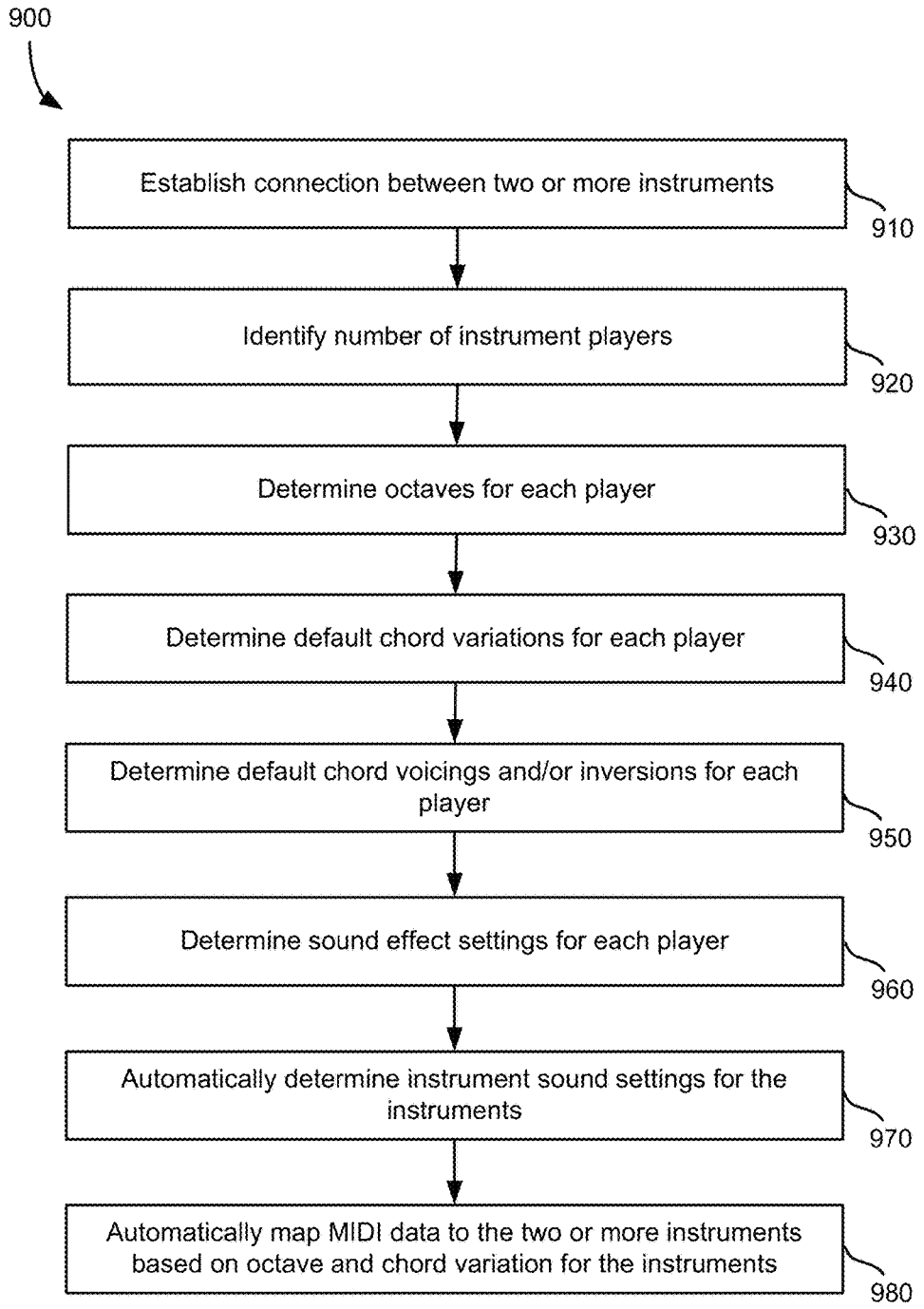
FIG. 9 is a method for coordinating playback of multiple musical instruments of the present technology.

FIG. 9 is a method for coordinating playback of multiple musical instruments of the present technology. A connection is established between two or more instruments at step 910. The connection may be a wired connection, a local wireless connection, or other wireless connection. A local wireless connection may be implemented by a radio frequency technology such as Bluetooth technology. Other wireless connections may include a Wi-Fi connection, cellular connection, or a combination of networks and wireless protocols. To establish a connection, a user networking module in each instrument, or in a mobile device connected to each instrument, may implement a handshake protocol to identify, confirm and connect with each of one or more other instruments. The number of instrument players is then determined at step 920. The number of instrument players can be used to determine how the musical instruments will be configured when they play together.

Octave or note ranges for each player of a musical instrument that is connected is determined at step 930. In some instances, if there are two or more instruments are connected together, a first instrument may be configured to play in a lower octave or note range, and a second instrument may be configured to play in a higher octave or note range. Additional instruments beyond the two instruments may also play in the first two ranges, or may be configured to play in a third or other note range. The octave or note ranges may partially or wholly overlap.

Default chord variations may be determined for each player within the established connection at step 940. The default chord variations may include a first player assigned a major chord variation, a second player assigned a different chord variation such as a power chord or suspended chord variation, and so forth. In some instances, the default chord variations may all have the same scale, key and root note. In other instances, some or all players may play identical chord variations.

Default chord voicings and/or inversions may be determined for each player within the established connection at step 950. The default chord voicings may include a first player assigned chords based on "open chords," while a second player is assigned chords based on "bane chords," and so on. In some instances, chord inversions are chords wherein the root note can change position in the chord "stack" so the root note can be on top, for example. Put in other words, the bass/lowest note of the chord can change to another note in the chord (e.g. the $3^{rd}$, $5^{th}$ or the $7^{th}$ (the $7^{th}$ in the case of a seventh chord)). So while the root notes of a chord are typically on the bottom, this is not always the case, in the case of a chord inversion.

Sound effect settings may be determined for each player at step 960. Each instrument may be configured with a different configuration of effects, such as reverb, chorus, echo/delay, compression, phaser, Hanger, or other modulation effect. The instrument sound settings are set for the instruments at step 970. For example, a first player may be configured in an electric guitar sound setting while a second player is configured to be in an acoustic guitar sound setting. Hence, the octaves, default chord variations, default chord voicings, sound effects, and instrument sound settings may be automatically set for a user based on the number of users that establish a connection at step 910. Once the settings are set for the instruments, note data (such as MIDI note values) may be automatically mapped to the two or more instruments at step 980. The note data may be based on the note range, chord variations, and chord voicings settings for the instruments.

Figure 10:
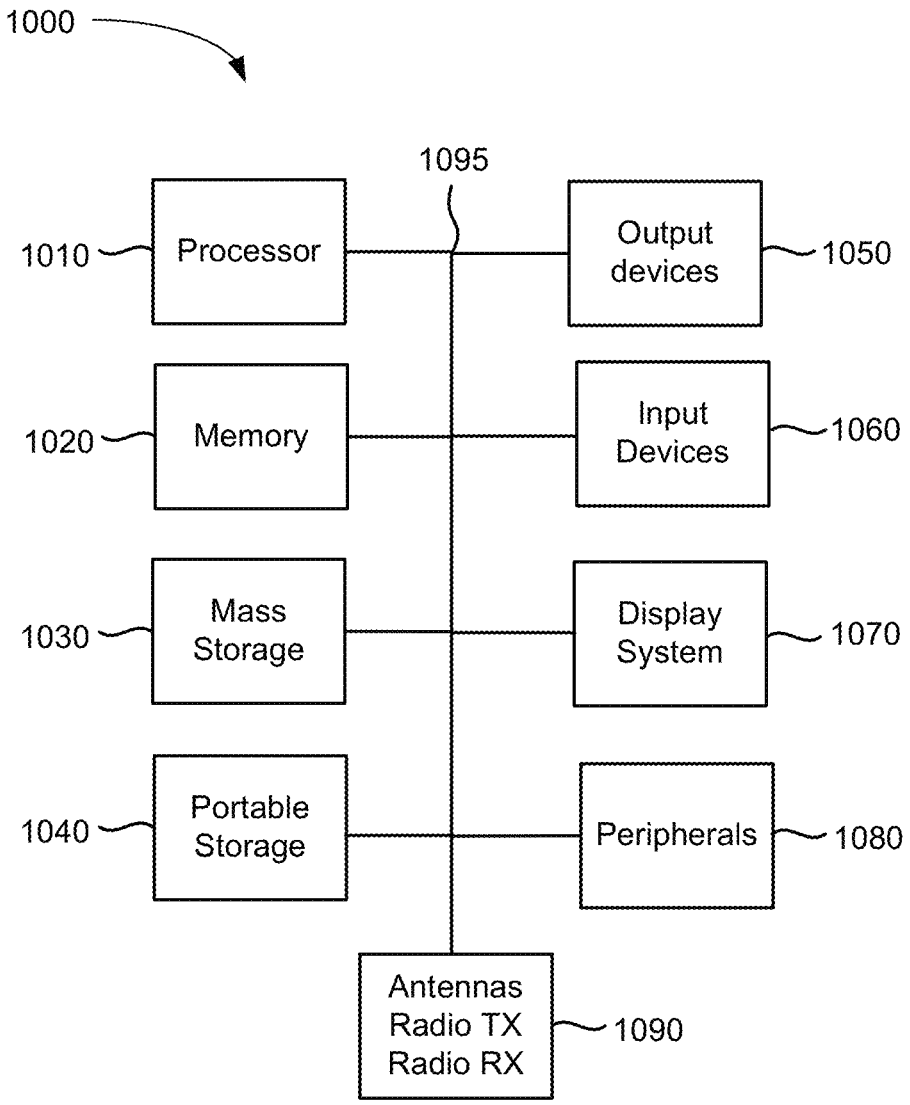
FIG. 10 is a block diagram of a computing environment for implementing the present technology.

FIG. 10 is a block diagram of a system for implementing the present technology. System 1000 of FIG. 10 may be implemented in the contexts of the likes of computing device 220 of FIG. 2. The computing system 1000 of FIG. 10 includes one or more processors 1010 and memory 1020. Main memory 1020 stores, in part, instructions and data for execution by processor 1010. Main memory 1020 can store the executable code when in operation. The system 1000 of FIG. 10 further includes a mass storage device 1030, portable storage medium drive(s) 1040, output devices 1050, user input devices 1060, a graphics display 1070, and peripheral devices 1080.

The components shown in FIG. 10 are depicted as being connected via a single bus 1090. However, the components may be connected through one or more data transport means. For example, processor unit 1010 and main memory 1020 may be connected via a local microprocessor bus, and the mass storage device 1030, peripheral device(s) 1080, portable storage device 1040, and display system 1070 may be connected via one or more input/output (I/O) buses.

Mass storage device 1030, which may be implemented with a magnetic disk drive, an optical disk drive, a flash drive, or other device, is a non-volatile storage device for storing data and instructions for use by processor unit 1010. Mass storage device 1030 can store the system software for implementing embodiments of the present invention for purposes of loading that software into main memory 1020.

Portable storage device 1040 operates in conjunction with a portable non-volatile storage medium, such as a floppy disk, compact disk or Digital video disc, USB drive, memory card or stick, or other portable or removable memory, to input and output data and code to and from the computer system 1000 of FIG. 10. The system software for implementing embodiments of the present invention may be stored on such a portable medium and input to the computer system 1000 via the portable storage device 1040.

Input devices 1060 provide a portion of a user interface. Input devices 1060 may include an alpha-numeric keypad, such as a keyboard, for inputting alpha-numeric and other information, a pointing device such as a mouse, a trackball, stylus, cursor direction keys, microphone, touch-screen, accelerometer, and other input devices Additionally, the system 1000 as shown in FIG. 10 includes output devices 1050. Examples of suitable output devices include speakers, printers, network interfaces, and monitors.

Display system 1070 may include a liquid crystal display (LCD) or other suitable display device. Display system 1070 receives textual and graphical information, and processes the information for output to the display device. Display system 1070 may also receive input as a touch-screen.

Peripherals 1080 may include any type of computer support device to add additional functionality to the computer system. For example, peripheral device(s) 1080 may include a modem or a router, printer, and other device.

The system of 1000 may also include, in some implementations, antennas, radio transmitters and radio receivers 1090. The antennas and radios may be implemented in devices such as smart phones, tablets, and other devices that may communicate wirelessly. The one or more antennas may operate at one or more radio frequencies suitable to send and receive data over cellular networks, Wi-Fi networks, commercial device networks such as Bluetooth devices, and other radio frequency networks. The devices may include one or more radio transmitters and receivers for processing signals sent and received using the antennas.

The components contained in the computer system 1000 of FIG. 10 are those typically found in computer systems that may be suitable for use with embodiments of the present invention and are intended to represent a broad category of such computer components that are well known in the art. Thus, the computer system 1000 of FIG. 10 can be a personal computer, hand held computing device, smart phone, mobile computing device, workstation, server, minicomputer, mainframe computer, or any other computing device. The computer can also include different bus configurations, networked platforms, multi-processor platforms, etc. Various operating systems can be used including Unix, Linux, Microsoft Windows, Apple OSX, iOS, and Android, and other suitable operating systems.

The foregoing detailed description of the technology herein has been presented for purposes of illustration and description. It is not intended to be exhaustive or to limit the technology to the precise form disclosed. Many modifications and variations are possible in light of the above teaching. For example, hardware illustrated and/or described herein may include additional or fewer components and/or circuitry, and software may include additional or fewer modules, objects or other code. Methods described herein with a plurality of steps may be performed such that the steps are in a different order than the order described and/or illustrated. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claims appended hereto.

What is claimed is:

1. A device for playing music with a configurable playing interface, comprising:

a housing, a plurality of chord selectors displaced on the housing;

an actuator displaced on the housing;

an antenna and circuitry for communication with a remote device, the antenna in communication with the circuitry for communication with the remote device, the circuitry for communication with the remote device displaced within the housing;

logic connected to the plurality of chord selectors and the actuator that maps note data to the plurality of chord selectors, the note data mapped to the plurality of chord selectors based on a key and scale selection associated with the device, the logic outputting note data in response to a first input received to a selected chord selector of the plurality of chord selectors and a second input to the actuator, the note data output to audio processing circuitry that creates audio based on the note data, the circuitry for communication with the remote device communicating at least one of the note data and the audio to the remote device; and logic for automatically mapping note data to each chord selector based on the selected scale and the selected key.

2. The device of claim 1, wherein the housing includes a body and a neck, the chord selectors displaced along the neck of the device.

3. The device of claim 1, wherein a subset of chord selectors associated with a degree of the scale is in a column on the neck of the instrument.

4. The device of claim 1, wherein each degree of the scale is associated with a different subset of chord selectors.

5. The device of claim 4, wherein the logic assigns a chord to each of the plurality of the chord selectors such that the root note of a chord is based on the note of the selected scale.

6. The device of claim 5, wherein the logic assigns chord variations to one or more subsets of the plurality of chord selectors, the chord variations of a particular subset having the same root note.

7. The device of claim 5, wherein the logic assigns chord variations to one or more subsets of the plurality of chord selectors, the chord variations of a particular subset having root notes that correspond to degrees present in the chromatic scale, but not in the selected diatonic scale.

8. The device of claim 1, further comprising logic for establishing a connection with one or more additional devices for playing music with a configurable playing interface.

9. The device of claim 8, wherein the logic for establishing a connection may configure the chord selectors based on the number of additional devices the device has established a connection.

10. The device of claim 1, wherein configuring the chord selectors may include configuring the chord selectors of each of two or more devices in a different octave.

11. The device of claim 1, wherein configuring the chord selectors may include configuring the chord selectors of each of two or more devices in a different chord voicing or chord inversion.

12. The device of claim 1, wherein the device is implemented as a guitar.

13. The device of claim 5, wherein the note data includes notes assigned to each string in a guitar.

14. The device of claim 1, wherein the audio processing circuitry that creates audio based the note data is displaced within the housing of the device.

15. The device of claim 1, wherein the audio processing circuitry that creates audio based the note data is external to the device.

16. The device of claim 1, wherein the actuator includes a plurality of strings.

17. The device of claim 1, wherein the input of the actuator includes a physical motion by a user that engages the actuator.

18. The device of claim 17, wherein the physical motion may include tapping, pushing, pulling, strumming, touching, pressing, picking, shaking, waving, or a gesture.

19. The device of claim 1, wherein a plurality of chord selectors positioned in a vertical row (fret) on a neck of the device have the same root note.

20. A method for playing a musical device with a configurable playing interface, comprising:

receiving a selection of a scale and a key by the musical device;

configuring a plurality of chord selectors on the musical device based on the scale and key;

receiving a first input at a selected chord selector of the plurality of chord selectors;

receiving a second input at an actuator at the musical device;

creating note data in response to receiving the first input and the second input, the note data based on the scale and key.

21. The method of claim 20, further including transmitting the note data to audio processing circuitry that creates audio based the note data values.

22. The method of claim 20, wherein the audio processing circuitry that creates audio based the note data is displaced within the housing of the device.

23. The method of claim 20, wherein the audio processing circuitry that creates audio based the note data is external to the device.

24. The method of claim 20, wherein configuring the plurality of chord selectors includes mapping note data for to each chord selector based on the scale and key.

25. The method of claim 21, wherein the note data includes note data for each string in a guitar, the note data forming a chord based on the scale and key, wherein each chord has a root note based on a degree in the received scale.

26. The method of claim 20, wherein the second input is detecting a physical motion by a user that engages one or more actuators by a user of the musical device.

27. The method of claim 26, further comprising detecting a velocity of the vibration of each of the one or more actuators, a volume of the output based on the detected magnitude.

28. The method of claim 20, further comprising establishing a connection between the musical instrument and a remote device, the scale and key received from the remote device.

29. The method of claim 20, further comprising:

establishing a connection between the musical instrument and one or more additional musical instruments; and configuring the plurality of chord selectors at least in part based on the number of additional musical instruments.

30. The method of claim 29, wherein configuring the plurality of chord selectors includes configuring chord voicings for each musical instrument.

31. The method of claim 29, wherein configuring the plurality of chord selectors includes configuring chord inversions for each musical instrument.

32. The method of claim 29, wherein configuring the plurality of chord selectors includes configuring different instrument sounds for each musical instrument.

33. The method of claim 29, wherein configuring the plurality of chord selectors includes configuring chord selector octaves or note ranges for each musical instrument.

34. The method of claim 29, wherein configuring the plurality of chord selectors includes configuring the musical instruments to be played as an ensemble.

35. A non-transitory computer readable storage medium having embodied thereon a program, the program being executable by a processor to perform a method for playing a musical device with a configurable playing interface, the method comprising:

receiving a selection of a scale and a key by the musical device;

configuring a plurality of chord selectors on the musical device based on the scale and key;

receiving a first input at a selected chord selector of the plurality of chord selectors;

receiving a second input a second input at the musical device;

outputting one or more notes through a speaker of the musical device, the one or more notes based on the scale, key, the first input and the second input.

36. The non-transitory computer readable storage medium of claim 35, wherein configuring the plurality of chord selectors includes mapping sound data for to each chord selector based on the scale and key.

37. The non-transitory computer readable storage medium of claim 36, wherein the sound data includes sound data for each string in a guitar, the sound data forming a chord based on the scale and key, wherein each chord has a root node based on a note in the received scale.

38. The non-transitory computer readable storage medium of claim 35, wherein the second input is detecting the strumming of one or more strings by a user of the musical device.

39. The non-transitory computer readable storage medium of claim 38, further comprising detecting a magnitude of the vibration of each of the one or more strings, a volume of the output based on the detected magnitude.

40. The non-transitory computer readable storage medium of claim 35, further comprising establishing a connection between the musical instrument and a remote device, the scale and key received from the remote device.

41. The non-transitory computer readable storage medium of claim 35, further comprising:

establishing a connection between the musical instrument and one or more additional musical instruments; and configuring the plurality of chord selectors at least in part based on the number of additional musical instruments.

42. A device for playing music with a configurable playing interface, comprising:

a housing, a plurality of chord selectors displaced on the housing;

an actuator displaced on the housing; and logic connected to the plurality of chord selectors and the actuator that maps note data to the plurality of chord selectors, the note data mapped to the plurality of chord selectors based on a key and scale selection associated with the device, the logic outputting note data in response to a first input received to a selected chord selector of the plurality of chord selectors and a second input to the actuator, the note data output to audio processing circuitry that creates audio based on the note data, wherein a plurality of chord selectors positioned in a horizontal row along a neck of the device are the same chord type or variation.

43. The device of claim 42, wherein the housing includes a body and a neck, the chord selectors displaced along the neck of the device.

44. The device of claim 42, wherein a subset of chord selectors associated with a degree of the scale is in a column on the neck of the instrument.

45. The device of claim 42, wherein each degree of the scale is associated with a different subset of chord selectors.

46. The device of claim 45, wherein the logic assigns a chord to each of the plurality of the chord selectors such that the root note of a chord is based on the note of the selected scale.

* * * * *